United States Patent [19]

Cintolo

[11] Patent Number: 4,838,042

[45] Date of Patent: Jun. 13, 1989

[54] METAL PLATE FOR PERSONALIZING A BRACELET

[76] Inventor: Carmelo Cintolo, 9, Via delle Terme, Florence, Italy

[21] Appl. No.: 189,339

[22] Filed: May 2, 1988

[30] Foreign Application Priority Data

Nov. 6, 1987 [IT] Italy ..... 11792/87[U]

[51] Int. Cl.[4] ..... A44C 5/00

[52] U.S. Cl. ..... 63/3; 63/21; 24/265 WS; 40/633

[58] Field of Search ..... 63/2, 3, 21, 20, 22, 63/23; 24/458, 265 B, 265 A, 265 WS; 40/633

[56] References Cited

U.S. PATENT DOCUMENTS

| | | | |
|---|---|---|---|
| 2,696,689 | 12/1954 | Speck et al. | 24/265 WS X |
| 3,027,665 | 4/1962 | St. John | 40/633 |
| 3,340,630 | 12/1967 | Becker | 40/633 |
| 3,455,043 | 7/1969 | Augustini | 40/633 |
| 4,542,630 | 12/1985 | Nanasi | 63/3 |

FOREIGN PATENT DOCUMENTS

| | | | |
|---|---|---|---|
| 597781 | 4/1978 | Switzerland | 63/3 |
| 617943 | 2/1949 | United Kingdom | 63/3 |

*Primary Examiner*—Kenneth J. Dorner
*Assistant Examiner*—Laurie K. Crammer
*Attorney, Agent, or Firm*—Browdy and Neimark

[57] ABSTRACT

A metal plate particularly of precious metal, for personalizing a bracelet, such as a metal watchband, formed by side-by-side rows of tubular links, comprising a plate member having two opposite edges from which two pairs of teeth extend inwardly and at least one tab perpendicular to the opposite edges. The teeth and the tab engage between adjacent links. Fastening means are provided for securing the plate member to the bracelet.

4 Claims, 1 Drawing Sheet

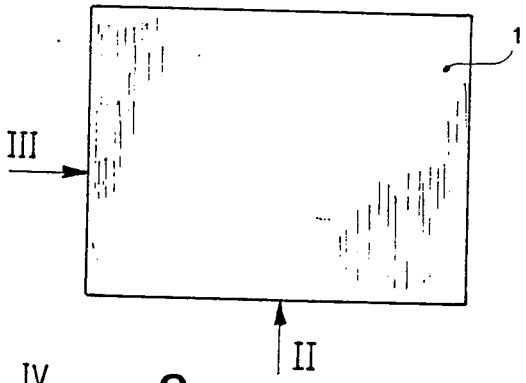
Fig. 1
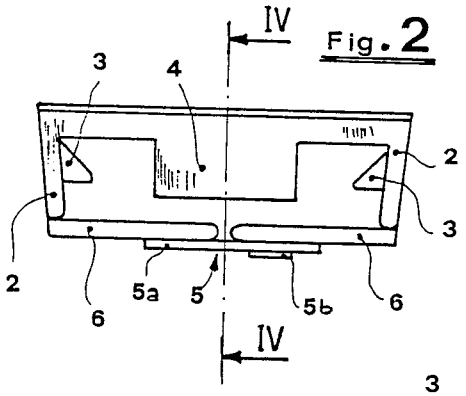
Fig. 2
Fig. 3
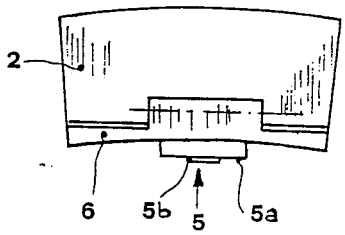
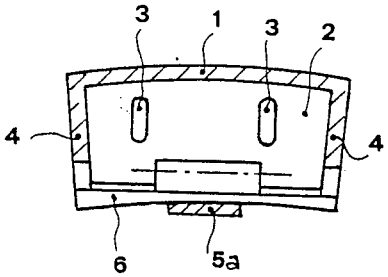
Fig. 4
Fig. 5
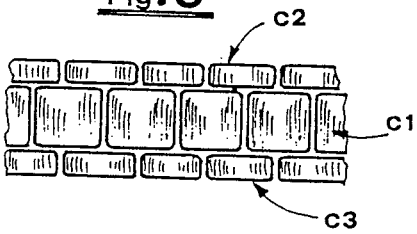

METAL PLATE FOR PERSONALIZING A BRACELET

DESCRIPTION

1. Field of the invention

The present invention relates to a metal plate, particularly in precious metal, suitable for personalizing a bracelet such as a metal watchband.

2. Status of the art

The above mentioned type of bracelet is formed by at least three side-by-side rows of substantially tubular links, wherein each link of the central row is articulated to two pairs of links of the two side rows by means of pins extending perpendicularly to the axial direction. This type of bracelet is generally used, according to many variations, as a watchband, but it can also be used as a merely ornamental bracelet.

The object of the present invention is to provide a metal plate fit for a simple and quick application to a bracelet as described above and suitable of being variously shaped and decorated according to individual likes.

SUMMARY OF THE INVENTION

The metal plate according to the invention comprises a plate member having two perpendicularly extending, opposite edges from which two pairs of opposed teeth protrude each against the other for engaging between adjacent link of the side rows of the bracelet, the plate member further having at least a tab perpendicular to said opposite edges extending in a parallel relation with respect to said opposed teeth for engaging between adjacent links of the central row of the bracelet, thus forming an axial and transverse fastening on the bracelet which prevent the plate member from sliding thereon. Fastening means articulated to the opposite edges of the plate member to secure it to the bracelet are further provided.

BRIEF DESCRIPTION OF THE DRAWINGS

The invention will be described in more detail with reference to a not limiting and exemplifying embodiment with reference to the attached drawings.

In the drawings:

FIG. 1 is a top plan view of the metal plate according to the invention;

FIG. 2 is a side view of the metal plate of FIG. 1 according to II;

FIG. 3 is another side view of the metal plate of FIG. 1 according to arrow III;

FIG. 4 is a sectional side view of the metal plate of the invention according to arrows IV—IV of FIG. 2; and FIG. 5 is a schematic plan view of a length of a bracelet to which the metal plate according to the invention can be secured.

DESCRIPTION OF THE PREFERRED EMBODIMENT

With reference to the above drawings, the metal plate according to the invention is formed of a plate member 1, which can be made of precious metal, of suitable size and thickness for use with a metal bracelet of watchband as that shown in FIG. 5. In the present embodiment, the plate member has been generally shown as of quadrilateral shape, but it is obvious that it can be made in any different shapes as long as they are suitable of being used in combination with the bracelet. Plate member 1 in the present embodiment, has a slightly convex surface.

FIG. 5 provides an example of a bracelet to which the metal plate according to the invention can be attached. This bracelet is formed by substantially tubular links, arranged side by side according three parallel rows, wherein the lateral rows C2 are articulated to the central row C1, formed of wider links, by means of pins perpendicular to the axial direction of the bracelet. Therefore, each link of the central row is articulated to a pair of links of the side rows on each side.

In order to render plate member 1 suitable for fastening to the above described bracelet, two axially opposite edges 2 are provided extending perpendicularly therefrom and each having a pair of inwardly facing teeth 3 on the inside surface. Teeth 3 are sized and spaced so that they fit in the spaces delimited by two adjacent links of the side rows C2. Two transverse tabs 4 extend perpendicularly from the same part of the edges 2 of plate member 1. Tabs 4 are sized and spaced so that they can fit into the spaces between two pairs of links of the central row C1. Once teeth 3 and tabs 4 are correctly positioned between the corresponding bracelet links, plate member 1 cannot slide either transversally or axially with respect to the bracelet.

Conventional fastener 5, for example snap or spring-type, are provided to fix the plate member to the bracelet. Fastener 5 comprises complementary connecting members **5*a* and 5*b* arranged on brackets 6 hinged to axially opposite edges 2. Advantageously, edges 2 and tabs 4 can be made to converge slightly in order to improve the hold of plate member 1 on the bracelet. As stated previously, the configuration of the plate member can be adapted to the shape and characteristics of the bracelet. For example, if attached to a graduated bracelet, that is a bracelet whose width decreases in the axial direction, the plate member can be shaped like a trapezoid. The visible surface of plate member 1** can be further decorated or embellished with engravings, surface treatments, precious stone setting and so on.

The invention is not to be considered as being limited by the embodiment described herein and it is understood that it comprises any form of variation or modification which falls within the scope of the claims appended hereto.

I claim:

1. A metal plate, particularly of precious metal, for personalizing a bracelet of the type formed by at least three side-by-side rows of substantially tubular links, wherein each link of the central row is articulated to two pairs of links of the two side rows, said metal plate comprising a plate member adapted to be removably connected to the bracelet and having two perpendicularly extending, opposite walls from which two pairs of opposed teeth means protrude towards each other for engaging between adjacent links of the side rows of the bracelet, said plate member being further provided with at least one tab means perpendicular to said opposite walls extending in parallel with respect to said opposed teeth means for engaging between adjacent links of the central row of the bracelet, and fastening means hinged to said walls for securing the plate member to the bracelet.

2. The metal plate according to claim 1, wherein said at least one tab means comprises two parallel tabs.

3. The metal plate according to claim 1, wherein said opposite walls and said at least one tab means of said plate member are slightly converging.

4. The metal plate according to claim 1, wherein said plate member has a convex surface.

* * * * *